US005101724A

United States Patent [19]

D'Heureuse et al.

[11] Patent Number: 5,101,724

[45] Date of Patent: Apr. 7, 1992

[54] DAMPENING UNIT FOR AN OFFSET PRINTING MACHINE

[75] Inventors: Walter D'Heureuse, Ladenburg; Hans-Jurgen Kusch, Neckargemund; Gerhard Heppenstiel, Bammental; Rudi Stellberger, Kronau, all of Fed. Rep. of Germany

[73] Assignee: Heidelberger Druckmaschinen AG, Heidelberg, Fed. Rep. of Germany

[21] Appl. No.: 211,988

[22] Filed: Jun. 27, 1988

[30] Foreign Application Priority Data

Jun. 25, 1987 [DE] Fed. Rep. of Germany ..... 3720986

[51] Int. Cl.[5] ..... B41L 23/00; B41F 1/46

[52] U.S. Cl. ..... 101/148; 101/348; 101/DIG. 38; 29/115

[58] Field of Search ..... 101/147, 148, 348, 349, 101/350, 363, 217, 218, DIG. 38; 29/115

[56] References Cited

U.S. PATENT DOCUMENTS

| | | | |
|---|---|---|---|
| 20,090 | 4/1858 | Reynolds | 101/DIG. 38 |
| 677,821 | 7/1901 | Tily et al. | 101/DIG. 38 |
| 916,432 | 3/1910 | Ford | 101/DIG. 38 |
| 996,827 | 7/1911 | Beadle | 101/DIG. 38 |
| 2,126,768 | 8/1938 | Goedike | 101/147 |
| 3,106,154 | 10/1963 | Saul . | |
| 3,280,733 | 10/1966 | Jurny | 101/147 |
| 3,625,148 | 12/1971 | Muselik et al. | 101/DIG. 38 |
| 3,769,909 | 11/1973 | Fugmau et al. . | |
| 4,332,195 | 6/1982 | Mizumura . | |
| 4,455,938 | 6/1984 | Loudon | 101/148 |

FOREIGN PATENT DOCUMENTS 3011031 10/1981 Fed. Rep. of Germany .

*Primary Examiner*—Eugene H. Eickholt

*Attorney, Agent, or Firm*—Herbert L. Lerner; Laurence A. Greenberg

[57] ABSTRACT

Dampening unit for an offset printing machine includes a metering roller, a dampening form roller for applying dampening medium to a plate cylinder of the printing machine, the metering roller and the form roller being in mutually pressing engagement at a contact zone along respective axially parallel lines on respective casings of the rollers, a drive for rotating the metering roller and the form rolelr with circumferential speeds which are substantially in a downward direction in vicinity of the contact zone, a storage space for dampening medium located above the contact zone and defined by surfaces of the casings of the metering roller and the form roller and sealing elements located at respective ends of the metering roller and the form roller, and a traversing distributor roller disposed in direct friction contact with the metering roller.

3 Claims, 1 Drawing Sheet

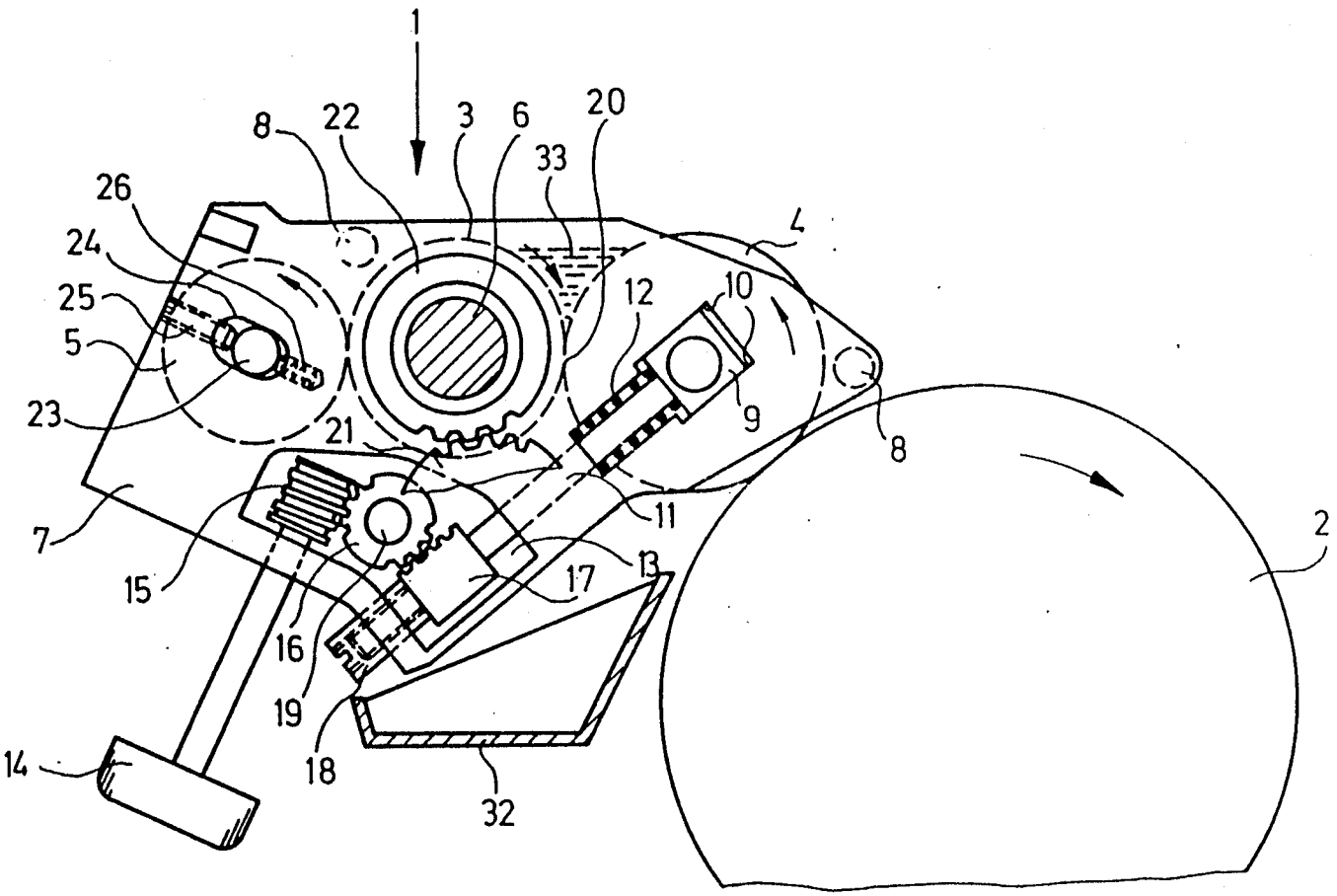
1
2
3
4
5
6
7
8
9
10
11
12
13
14
15
16
17
18
19
20
21
22
23
24
25
26
32
33

DAMPENING UNIT FOR AN OFFSET PRINTING MACHINE

The invention relates to a dampening unit for an offset printing machine which includes a metering roller, a dampening form roller for applying dampening medium to a plate cylinder of the printing machine, the metering roller and the form roller being in mutually pressing engagement at a contact zone along respective axially parallel lines on respective casings of the rollers, drive means for rotating the metering roller and the form roller with circumferential speeds which are substantially in a downward direction in vicinity of the contact zone, means defining a storage space for dampening medium located above the contact zone and including surfaces of the casings of the metering roller and the form roller and sealing elements located at respective ends of the metering roller and the form roller, and a traversing distributor roller cooperating with a surface of one of the other rollers.

Such a dampening unit has become known heretofore from German Published Non-prosecuted Application (DE-OS) 22 06 498 wherein an oscillating friction roller is disclosed which is arranged at a form roller between a location at which the latter is in contact with a plate cylinder, and a storage space for dampening medium in a wedge or nip between the form roller and a metering roller disposed in contact therewith. Distribution, which is desirable in itself, has been dispensed with more recently in order to permit unhampered return of excess dampening medium from the plate cylinder to the storage space (note U.S. Pat. No. 4,455,938).

It is accordingly an object of the invention to provide a dampening unit of the foregoing general type with which it is possible to effect both a distribution of dampening medium as well as an unhampered or unobstructed return or reconveyance of excess dampening medium from the plate cylinder to the dampening-medium storage space.

With the foregoing and other objects in view, there is provided, in accordance with the invention, a dampening unit for an offset printing machine, comprising a metering roller, a dampening form roller for applying dampening medium to a plate cylinder of the printing machine, the metering roller and the form roller being in mutually pressing engagement at a contact zone along respective axially parallel lines on respective casings of the rollers, drive means for rotating the metering roller and the form roller with circumferential speeds which are substantially in a downward direction in vicinity of the contact zone, means defining a storage space for dampening medium located above the contact zone and including surfaces of the casings of the metering roller and the form roller and sealing elements located at respective ends of the metering roller and the form roller, and a traversing distributor roller disposed in direct friction contact with the metering roller. The arrangement of the distributor roller in the dampening unit according to the invention has the effect of counteracting or inhibiting both so-called stencilling as well as the formation of lines of excess dampening-medium.

With this arrangement of the distributor roller, however, the advantage derived from its evening-out action should not be bought at the expense of introducing another disruptive influence which occurs in conventional dampeners of this general type, namely that the casing surface of the form roller is contacted by a distributor roller along its path from the plate cylinder to the dampening-medium storage space, which can disrupt the otherwise unhampered reconveyance or return of dampening medium from the plate cylinder to the dampening-medium storage space.

In accordance with another feature of the invention, the dampening unit includes drive means for form-lockingly or positively driving the metering roller, which ensures reliability.

In accordance with a concomitant feature of the invention, the drive means comprise drive gearing meshing with a gear affixed to the metering roller.

Moreover, the arrangement of the distributor roller in the invention according to the instant application has the advantage that a film of dampening medium forming in the contact zone can be transported without any disruption to the plate cylinder.

Other features which are considered as characteristic for the invention are set forth in the appended claims.

Although the invention is illustrated and described herein as embodied in dampening unit for an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of a drawing which is a diagrammatic side elevational view, partly in section, of an embodiment of the dampening unit according to the invention.

Referring now to the figure of the drawing, there is shown therein a dampening unit 1 engaged with a plate cylinder 2 and made up of a metering roller 3 which is in contact with an applicator or form roller 4 for the dampening medium which, in turn, is in contact with a distributor roller 5. A shaft 6 carrying the metering roller 3 is accommodated at both ends thereof in respective non-illustrated stationary bearings of the machine. A respective bearing plate 7 is disposed at the end faces of the metering roller 3 on a respective shaft pin of the shaft 6 so as to be pivotable about the latter. Both of the bearing plates 7 are mutually connected by traverses 8. The applicator or form roller 4 is mounted by the ends thereof in respective guide shoes 9, only one of which is shown in the figure, the guide shoes 9, in turn, sliding on rectilinear guiding surfaces 10 which are machined into the bearing plates 7. These guiding surfaces 10 extend substantially parallel to the direction of a tangent to the plate cylinder 2 at its contact point with the form roller 4. The guide shoes 9, respectively, are connected to a respective free end of a shaft 11 formed with a thread and extending in the direction of the guiding surfaces 10 and guided by the respective bearing plate 7. A respective compression spring 12 braced against the bearing plate 7 biases the respective guide shoe 9 in the direction of "Releasing the contact thereof with the metering roller". The shaft 11, furthermore, passes through a recess 13 formed in the respective bearing plate 7, wherein a respective adjusting drive for the respective guide shoe 9 is provided. The respective adjusting drive is formed of a toothed rack 17 arranged slidably on the shaft 11 and abutting an adjustable sleeve 18 screwed onto the thread of the shaft 11, and a non-illustrated gear meshing with the toothed rack 17 and disposed coaxially with a worm gear 16. The non-illustrated gears for adjusting the respective toothed rack 17 of each of the adjusting drives, respectively, are both fastened in common on one adjusting shaft 19. Furthermore, the worm gear 16 meshing with a worm 15 is also fastened to this adjusting shaft 19, so that the adjusting shaft 19 is turnable by an actuating member 14 arranged on the worm 15.

Dampening medium is located in an upper wedge or nip 33 between the metering roller 3 and the form roller 4 and enclosed therein by suitable non-illustrated seals or sealing elements at the end faces of the rollers 3 and 4. A quantity of dampening medium adjustable by the mutual pressing-together of these rollers 3 and 4 with the aid of the actuating member 14 is fed or advanced to the plate cylinder 2 through the contact zone 20 of these rollers 3 and 4 via the casing surface of the form roller 4 located below the contact zone 20. In this regard, the dampening unit is equipped with a drive 21, 22 for rotating the metering roller 3 and the form roller 4, with the circumferential speeds of these rollers being in a downward direction in vicinity of the contact zone 20, as seen in the figure. This drive 21, 22 drives the metering roller 3 at the same circumferential speed as that of the plate cylinder 2. This occurs via a driving gear 21 of a gear train of the printing machine which meshes with a gear 22 arranged coaxially with the metering roller 3 and connected therewith by a non-illustrated free-wheeling gear or the like. The metering roller 3 drives the form roller 4 by friction at the contact zone 20.

A traversing distributor roller 5 is disposed in contact with the metering roller 3 opposite the contact zone 20 and rotates and traverses due to by friction with the metering roller 3. In this regard, the ends of the shaft 23 of the distributor roller 5 are received, in a manner wherein they are fixed against rotation, in respective slots 24 formed in the respective bearing plates 7. The respective slot 24 extends substantially in a direction towards the metering roller 3 and has a width which matches the diameter of the shaft 23. The shaft 23 is fastened within the slot 24 by means of a respective setscrew 25 which is screwed into the bearing plate 7 and presses the shaft 23 against a compression spring 26 located opposite the setscrew 25 in the bearing plate 7.

There are claimed:

1. Dampening unit for an offset printing machine, comprising a metering roller, a dampening form roller for applying dampening medium to a plate cylinder of the printing machine, said metering roller and said form roller being in mutually pressing engagement at a contact zone along respective axially parallel lines on respective casings of said rollers, drive means for rotating said metering roller and said form roller with circumferential speeds which are substantially in a downward direction in vicinity of said contact zone, means defining a storage space for dampening medium located above said contact zone and including surfaces of said casings of said metering roller and said form roller and sealing elements located at respective ends of said metering roller and said form roller, and a traversing distributor roller disposed in direct friction contact with said metering roller.

2. Dampening unit according to claim 1, including drive means for positively driving said metering roller.

3. Dampening unit according to claim 2, wherein said drive means comprise drive gearing meshing with a gear affixed to said metering roller.

* * * * *